US008235516B2

(12) United States Patent
Auslander et al.

(10) Patent No.: US 8,235,516 B2
(45) Date of Patent: Aug. 7, 2012

(54) PRINT ENHANCEMENT OF PIXELS TO IMPROVE READABILITY

(75) Inventors: Judith D. Auslander, Westport, CT (US); Douglas B. Quine, Bethel, CT (US)

(73) Assignee: Pitney Bowes Inc., Stamford, CT (US)

( * ) Notice: Subject to any disclaimer, the term of this patent is extended or adjusted under 35 U.S.C. 154(b) by 892 days.

(21) Appl. No.: 12/337,792

(22) Filed: Dec. 18, 2008

(65) Prior Publication Data

US 2010/0157007 A1 Jun. 24, 2010

(51) Int. Cl.
*B41J 2/01* (2006.01)

(52) U.S. Cl. ..... 347/96; 347/98; 347/100; 347/40

(58) Field of Classification Search ..... 347/6, 96, 347/98, 100, 102, 107, 40–43
See application file for complete search history.

(56) References Cited

U.S. PATENT DOCUMENTS

| | | | | |
|---|---|---|---|---|
| 711,933 | A | 10/1902 | Black | |
| 5,625,397 | A * | 4/1997 | Allred et al. | 347/100 |
| 6,102,537 | A * | 8/2000 | Kato et al. | 347/101 |
| 6,267,476 | B1 * | 7/2001 | Kato et al. | 347/100 |
| 6,428,143 | B2 | 8/2002 | Irihara et al. | |
| 6,547,358 | B1 | 4/2003 | Tanaka et al. | |
| 6,585,364 | B2 * | 7/2003 | Kasperchik et al. | 347/98 |
| 6,672,718 | B1 | 1/2004 | Stovold | |
| 7,104,643 | B2 | 9/2006 | Glass et al. | |
| 7,562,956 | B2 * | 7/2009 | Yamazaki et al. | 347/14 |
| 7,604,319 | B2 * | 10/2009 | Hirakawa | 347/21 |
| 2002/0018088 | A1 * | 2/2002 | Takahashi et al. | 347/15 |
| 2008/0001983 | A1 | 1/2008 | Kawakami et al. | |

FOREIGN PATENT DOCUMENTS

| | | | |
|---|---|---|---|
| EP | 1291187 | A1 | 3/2003 |
| JP | 2004291401 | A1 | 10/2004 |
| WO | 2008133630 | A1 | 11/2008 |

OTHER PUBLICATIONS

European Search Report for EP Application No. 09014046.8-2304.

* cited by examiner

*Primary Examiner* — Matthew Luu
*Assistant Examiner* — Rut Patel
(74) *Attorney, Agent, or Firm* — Steven J. Shapiro; Charles R. Malandra, Jr.

(57) ABSTRACT

A method to improve the image of a printed barcode by enhancing coverage of the print pixels within solid printed areas to improve the print uniformity and decrease the graininess of the typical ink jet printing by dissolving a small percentage of the colorant and distributing more uniformly. The parameter improved by the invention is the graininess or uniformity of coverage. The contrast ratio within barcode data elements can be also improved without causing unwanted image bleed into unintended areas. Hence, the printed barcode will contain more clearly defined printed and non printed areas to enable the barcode to be accurately read. The invention prevents also unwanted bleeding in areas where it could lower the quality of the printed material by avoiding application of enhanced coverage facilitators when desired white space is identified within a minimum distance.

8 Claims, 6 Drawing Sheets

PRINT ENHANCEMENT OF PIXELS TO IMPROVE READABILITY

FIELD OF THE INVENTION

The invention relates generally to the field of printing and more particularly to improving the readability of printed matter.

BACKGROUND OF THE INVENTION

Printed matter needs to be printed with a high level of quality to ensure readability by automation equipment, especially when old technology readers require very high print contrast ratios to ensure readability. The problem is particularly evident when barcodes are automatically read by postal automation equipment and other barcode readers.

Barcodes have been used in a wide variety of applications as a source for information. Typically barcodes are used at a point-of-sale terminal in merchandising for pricing and inventory control. Barcodes are also used in controlling personnel access systems, mailing systems, and in manufacturing for work-in process and inventory control systems, etc. The barcodes themselves represent numbers or alphanumeric characters by series of adjacent stripes of various widths, (i.e. a width modulated universal product code), heights (i.e. a height modulated POSTNET barcode), or position (2D barcode).

An ordinary barcode is a set of binary numbers. It typically consists of black bars and white spaces. A wide black bar space may signify a one and a thin black bar or space may signify a zero. The binary numbers stand for decimal numbers or letters. There are several different kinds of barcodes. In each one, a number, letter or other character is formed by a pre-established number of bars and spaces.

Width modulated barcodes are "vertically redundant", meaning that the same information is repeated vertically. They are in fact a one-dimensional code. The heights of the bars can be truncated without any lose of information. A two-dimensional code stores information along the height as well as the length of the symbol. Thus, in the same area more information may be stored in a two dimensional barcode than in a one dimensional barcode.

Current technology printers may leave small unintended voids between pixels which prevent achievement of the highest print contrast and uniform coverage of which the ink dyes or pigments are theoretically capable of. Such unintended voids are caused by the nature of ink jet printing of placing small drops (1-50 pL) on rough surface of paper with "peaks and valleys". The ink jet drops do not reach the paper surface in a uniform way and therefore cause to "graininess" as defined by the Standard ISO 13660, herein incorporated by reference, or non uniform print coverage especially on plain paper. Therefore the result is a degradation of the print quality of printed images. In comparison the mass thermal transfer printing achieves a uniform print coverage with the melt wax bridging the irregularities of the paper surface.

These characteristics affect the uniformity of the modules printed in the 2 D bar codes which might be interpreted as background by scanners. Barcodes, are also very sensitive to ink in unwanted locations—the line of contact and the white spaces in barcodes must be preserved and readability can be severely impacted if ink is allowed to bleed into regions which are intended to be blank (print growth).

One of the problems of the prior art is that it is often difficult to automatically read printed information.

Another problem of the prior art is that s often difficult to automatically read printed information that has a low print contrast ratio which is due to non optimal print coverage.

SUMMARY OF THE INVENTION

This invention overcomes the disadvantages of the prior art by providing a method to improve barcode print image quality by printing the bar code ink from one printhead or trench and then applying the solvent from a second printhead on the first printed image in order to improve the printed area uniformity. The conditions of the 2 inks to be printed are the following: the first ink has to have a low percentage of colorant soluble in the post printed solvent and the solvent has to be able to wet the first print efficiently during the printing process. The invention utilizes a print head to cause localized improvement by applying a fluid that acts on prints generated by another print head.

The invention also prevents bleeding into unwanted areas where it could lower the quality of the printed material by utilizing the localized (targeted) print capabilities of print heads.

DETAILED DESCRIPTION OF THE PREFERRED EMBODIMENT

Figure 1:
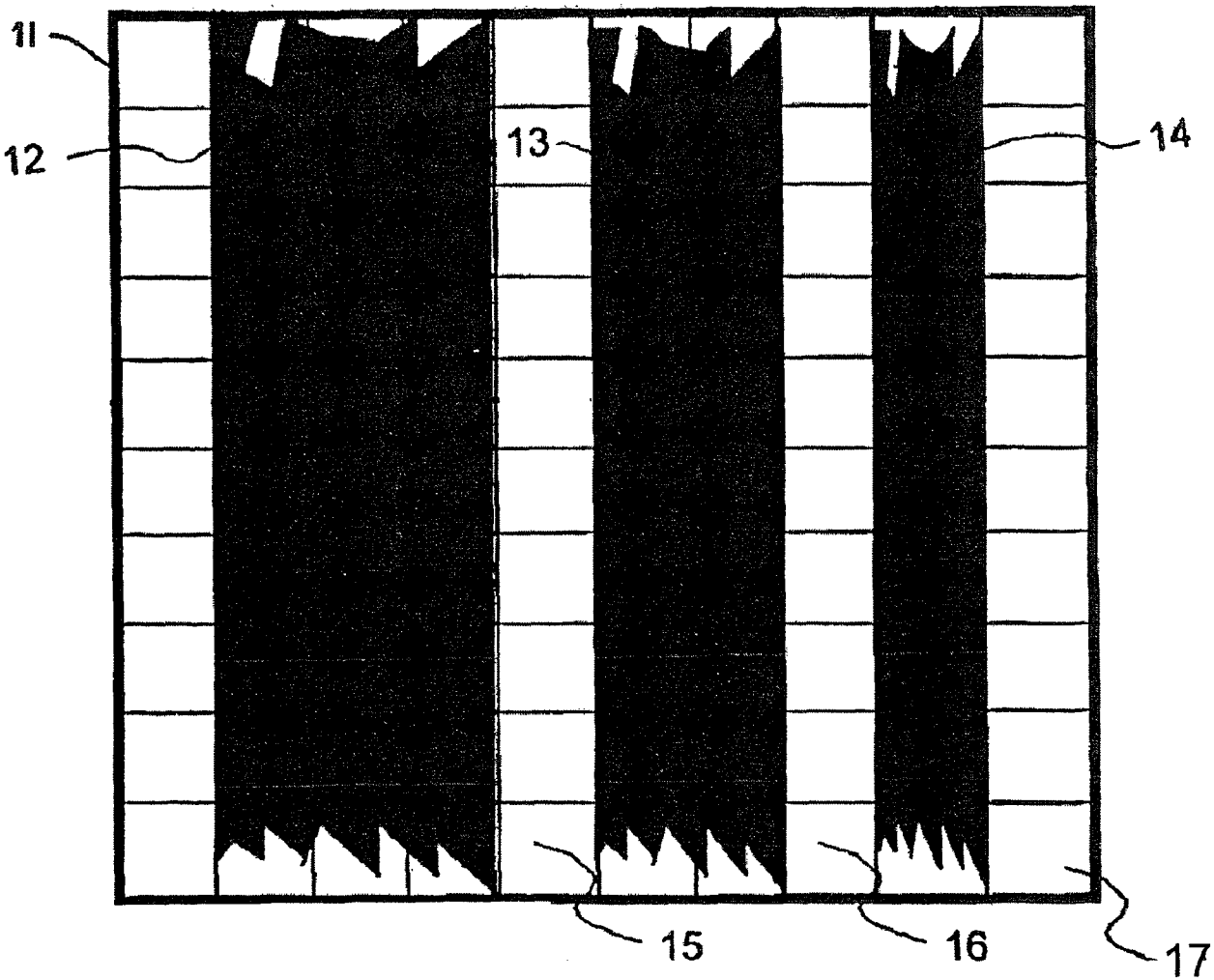
FIG. 1 illustrates in enlarged detail portions of code bars of an ideal one dimensional barcode.

Referring now to the drawings in detail, and more particularly to FIG. 1, the reference character 11 represents an enlarged detail portion of a width modulated barcode. Barcode 11 contains bars 12, 13 and 14 and spaces 15, 16 and 17. Bar 12 is three pixels wide, bar 13 is two pixels wide, and bar 14 is one pixel wide. Bar 12 represents a unique number (i.e., three), bar 13 represents a unique number (i.e., two), and bar 14 represents a unique number (i.e., one). Spaces 15, 16 and 17 are one unit wide.

Figure 2:
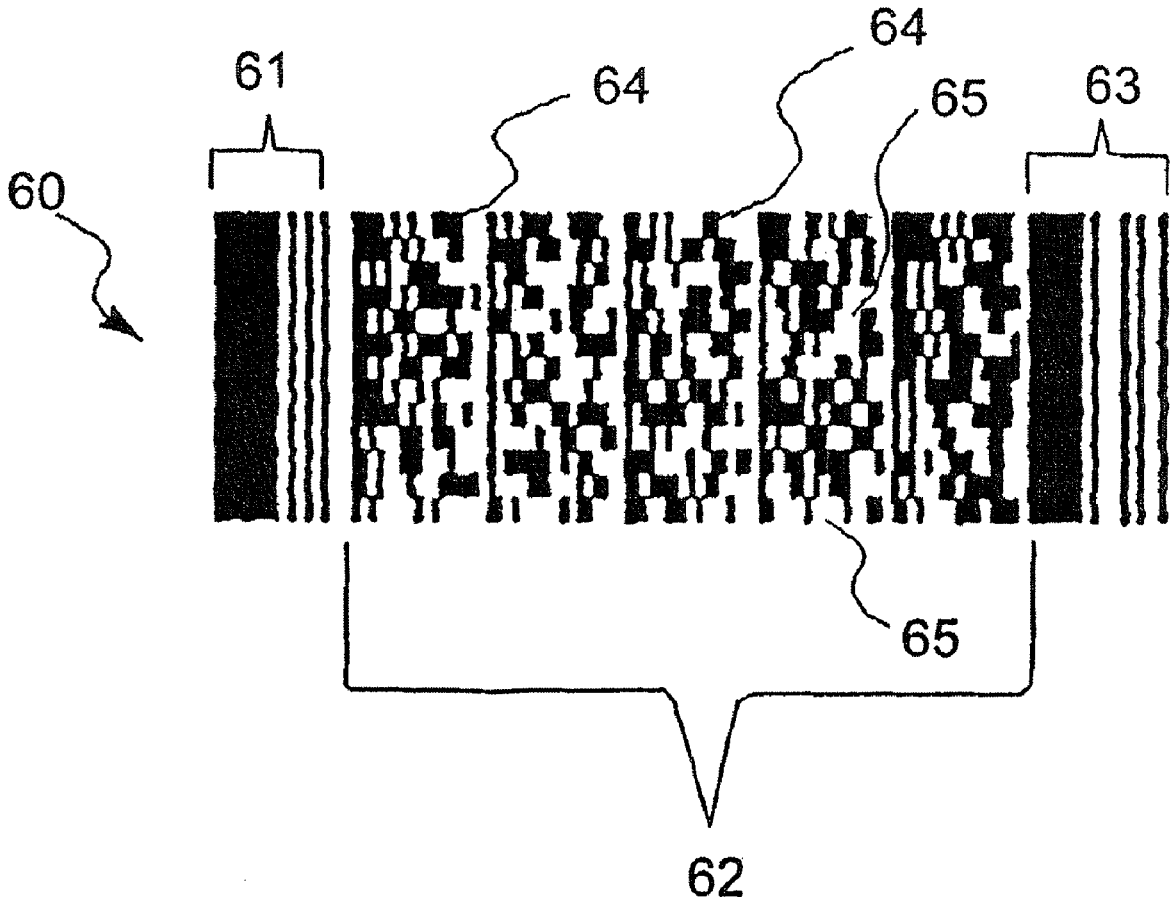
FIG. 2 is a drawing of a two dimensional (2-d) barcode.

FIG. 2 is a drawing of a two dimensional (2-d) barcode 60. Barcode 60 includes: a start pattern 61, that informs a scanner (not shown) when to begin reading data; a data portion 62; and a stop pattern 63, that informs a scanner when to stop reading data. Data portion 62 comprises printed barcode data elements (rectangles) 64 and non printed barcode data elements (spaces) 65. The coded information represented by data portion 62 is contained in the relative positions of the printed (64) and non printed (65) barcode data elements that are scanned.

Figure 3:
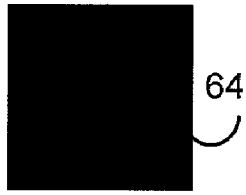
FIG. 3 illustrates in enlarged detail an idealized black rectangle 64 of FIG. 2.

FIG. 3 illustrates in enlarged detail an idealized black rectangle 64 of FIG. 2.

Figure 4:
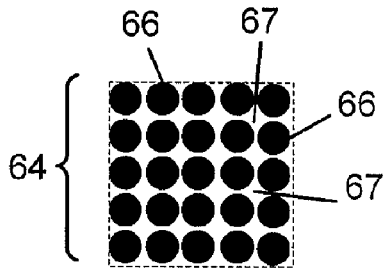
FIG. 4 illustrates in enlarged detail a barcode data element (black rectangle 64) of FIG. 2 that comprises a matrix of 5 by 5 printed pixels.

FIG. 4 illustrates in enlarged detail a black rectangle 64 of FIG. 2 that comprises a matrix of 5 by 5 printed pixels 66. The printed pixels 66 have unintended voids 67 between them. The print contrast within the printed area of rectangle 64 is diluted by the unintended voids 67 or white space between pixels 66 resulting in an average lower optical density and therefore lowered contrast ratio even in the presence of an "ideal" 100% black ink.

Figure 5:
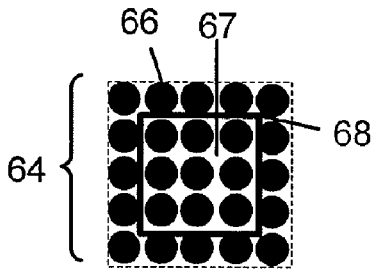
FIG. 5 illustrates in enlarged detail a barcode data element (black rectangle 64) of FIG. 2 that comprises a matrix of 5 by 5 printed pixels 66, showing pixels 66 in the enhanced coverage area 68 of rectangle 64.

FIG. 5 illustrates in enlarged detail a black rectangle 64 of FIG. 2 that comprise a matrix of 5 by 5 printed pixels 66, including nine pixels 66 in the enhanced coverage area 68 of rectangle 64. A facilitator (e.g. water) of the black ink that prints pixels 66 may be applied to the enhanced coverage area 68 (before or after printing). The pixel trimmed area 68 has been defined as the area remaining after trimming one row of pixels 66 off the top and bottom of the original rectangle 64 and one column off the left and right of the original rectangle 64. This prevents any unwanted bleeding of the image outside the intended boundaries of rectangle 64. This facilitator causes enhanced coverage of the pixels 66 in area 68 resulting in the image displayed in FIG. 6 after the ink dries. Any number of pixels may be trimmed in different applications (more may be trimmed at higher print resolutions). The pixel trimming may also be different in different directions. For instance, the manufacturing process of paper results in a "grain" of preferred fiber orientation. Ink may show unintended bleed differently along the grain of the paper than across the grain of the paper. Therefore it may be desirable for the print area 68 for facilitator application to be trimmed more from the original rectangle 64 along the long axis (with the grain) of the paper than across the grain. A first print head may be used to apply a facilitator like water. The first print head may also be an existing print cartridge containing both ink and facilitator which is utilized for this function. And a second print head, like Xerox Y100 produced by Xerox Corporation, 100 South Clinton Avenue, Rochester, N.Y. 14644, may be used to print pixels 66 with a black ink.

Figure 6:
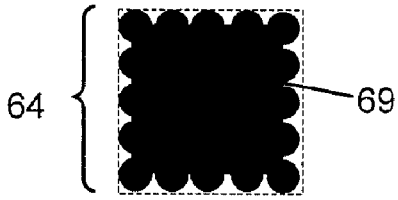
FIG. 6 illustrates in enlarged detail a barcode data element (64) of FIG. 5 that that formed an almost solid black area 69 after the facilitator evaporated.

FIG. 6 illustrates in enlarged detail a black rectangle 64 of FIG. 5 that formed an almost solid black area 69 after the ink dried. The print quality and readability of rectangle 64 is improved because rectangle 64 is practically a solid black mass that contains no white areas or voids. The enhanced coverage printed area has been homogenized (resulting in a more uniform optical density within the area) by adding the facilitator.

Figure 7:
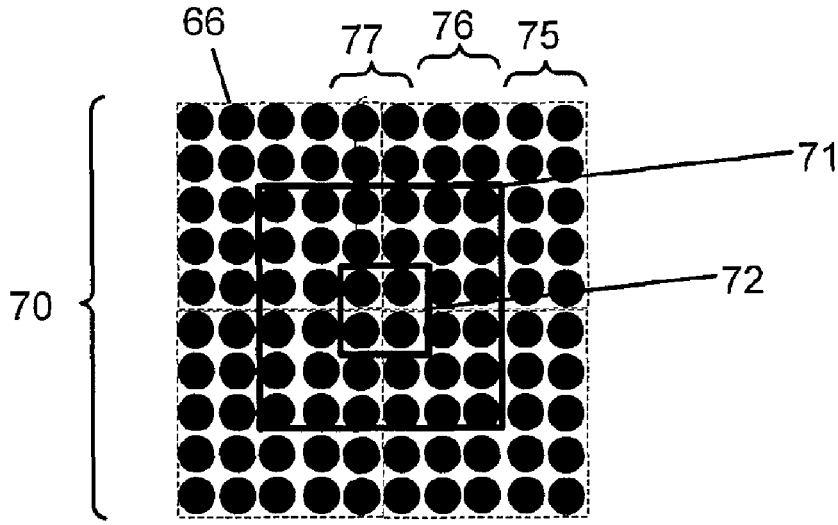
FIG. 7 illustrates a large black rectangle 70 that comprises a matrix of 10 by 10 printed pixels 66, showing the pixel trimmed facilitator print area 71 with a subset rectangular reduced print area 72 for reduced facilitator print.

The present invention recognizes that parameters may be set to define the number of pixels to trim (possibly different values in different axes or different values for the lead and trailing sides of print areas) from the outer perimeter of a rectangle to ensure that the facilitator induced enhanced coverage of individual pixels 66 does not cause unintended bleed beyond the boundaries of printed rectangles 64. FIG. 7 illustrates a print rectangle 70 from which two pixel columns (75) have been stripped from the right and left side (as well as pixel rows from the top and bottom) to define the reduced print area rectangle 71.

A further embodiment of this invention recognizes that when large solid rectangles (70) are printed on paper, there may be a central area (rectangle 72) in which ink tends to pool because the paper fibers are saturated with ink. Therefore, a second parameter may be defined which further limits the maximum solid rectangular area (71) over which facilitator will be applied. In FIG. 7, while facilitator will be applied to the rectangular area 71, it will be applied in reduced volume (e.g. 50%) in the inner rectangular reduced print area (72). Considering a cross section of this printed area therefore, we observe that the entire rectangle (70) has been printed with black ink. The facilitator raster print area has been defined as the original print area (70) less a two pixel boundary (75) on the right, left, top, and bottom resulting in a facilitator print area of rectangle 71. We have further defined an inner rectangular reduced print area (72) in which the facilitator application will be at a reduced rate of 50%. This rectangle could be computed as the facilitator print area less a defined number of border pixels (76) resulting in 4 pixels (77) trimmed from the original rectangle height (and 4 from the width) to which the reduced facilitator volume is applied to prevent ink pooling.

Figure 8:
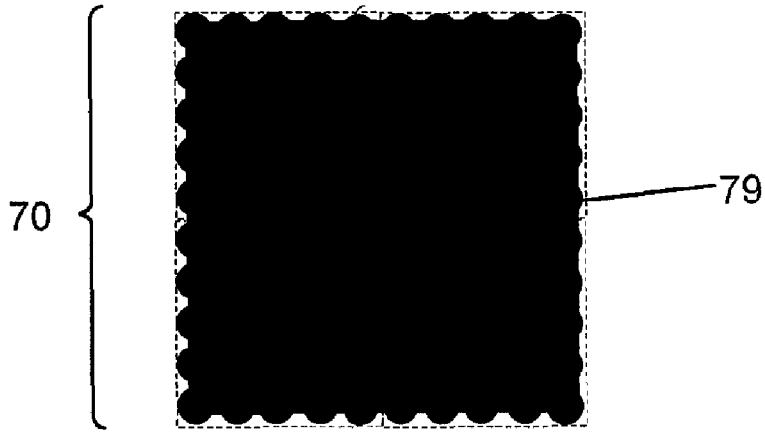
FIG. 8 illustrates in enlarged detail a black rectangle 70 of FIG. 7 that that formed an almost solid black area 79 without pooling after the facilitator evaporates.

FIG. 8 shows the result of this process in which region 79 provides enhanced coverage of the print area with homogenized optical density within the bounds of the rectangle 70.

Figure 9:
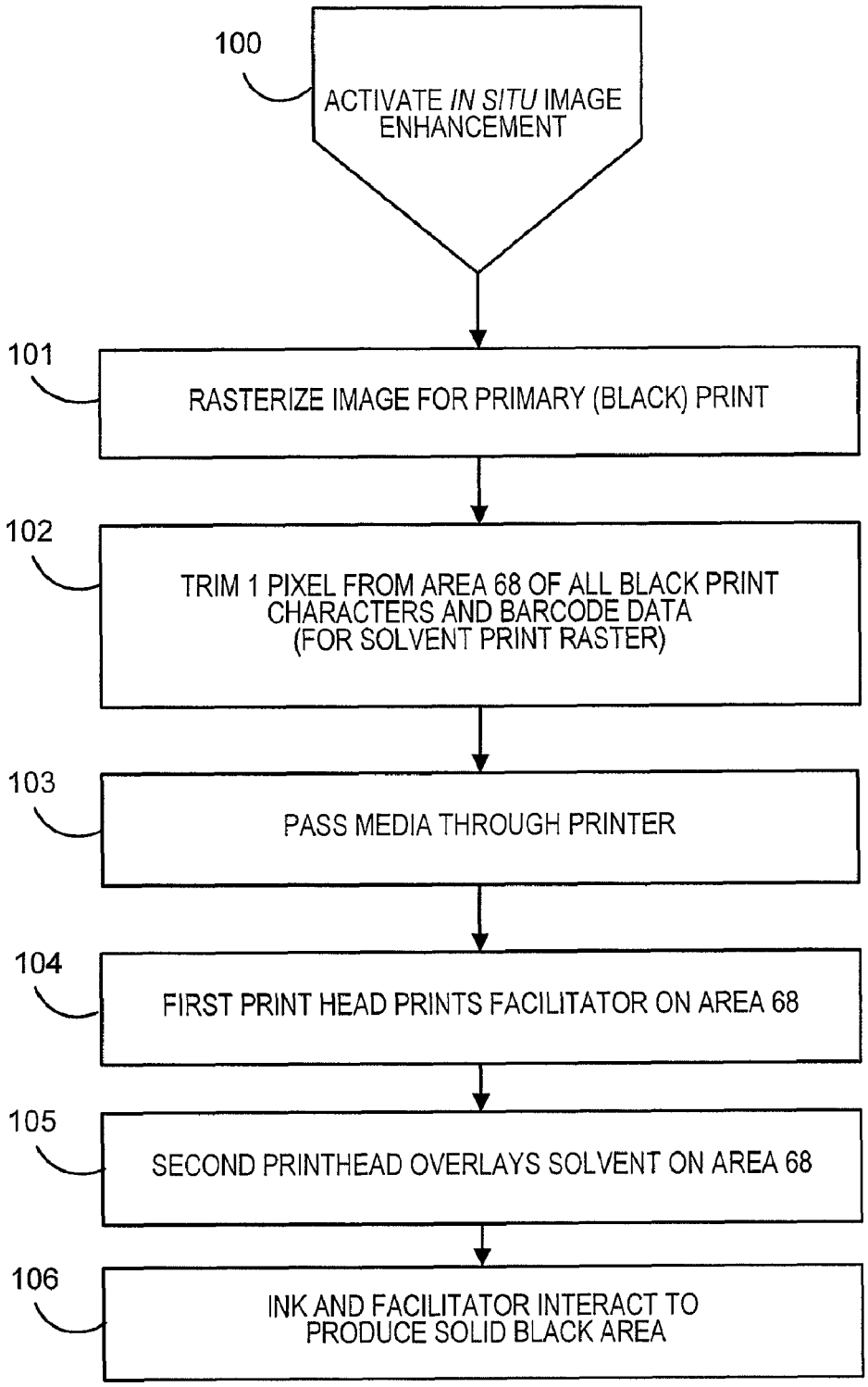
FIG. 9 is a process flow diagram of the printing of rectangle 64 of FIG. 6.

FIG. 9 is a process flow diagram of the printing of rectangle 64 of FIG. 6. The process begins in step 100 to activate in situ image enhancement. Then in step 101 the image is rasterized for the printing of rectangle 64 with black ink. The process of image rasterization for printing is well known in the industry. Rasterization means that the original two dimensional image is converted into a series of strips (rows) by the computer. For each potential print pixel a determination is made as to whether it should be printed in black or left unprinted (white). This raster data is then used to drive print commands or signals to the print head as it scans across the corresponding points on the unprinted paper. Now in step 102 the present invention takes the existing rasterized image and trims one (or more as desired) pixel from all contiguous solid print areas to generate the corresponding enhanced print area 68 facilitator print raster data. Pixels are not trimmed from rectangles 64 which are completely surrounded (within the contiguous print area) by other printed rectangles 64. In step 103 the media is passed through the printer. As it passes through, in step 104 the first (facilitator) print head prints (overlays) facilitator on all subset areas 68 within rectangles 64. Then in step 105 the second (ink) print head of the printer prints pixels 66 in all rectangles 64 as directed by the black ink raster data. Now in step 106 the facilitator and ink produce an enhanced coverage solid black area 69 that contains virtually no white areas or voids within the boundaries of rectangles 64.

Figure 10:
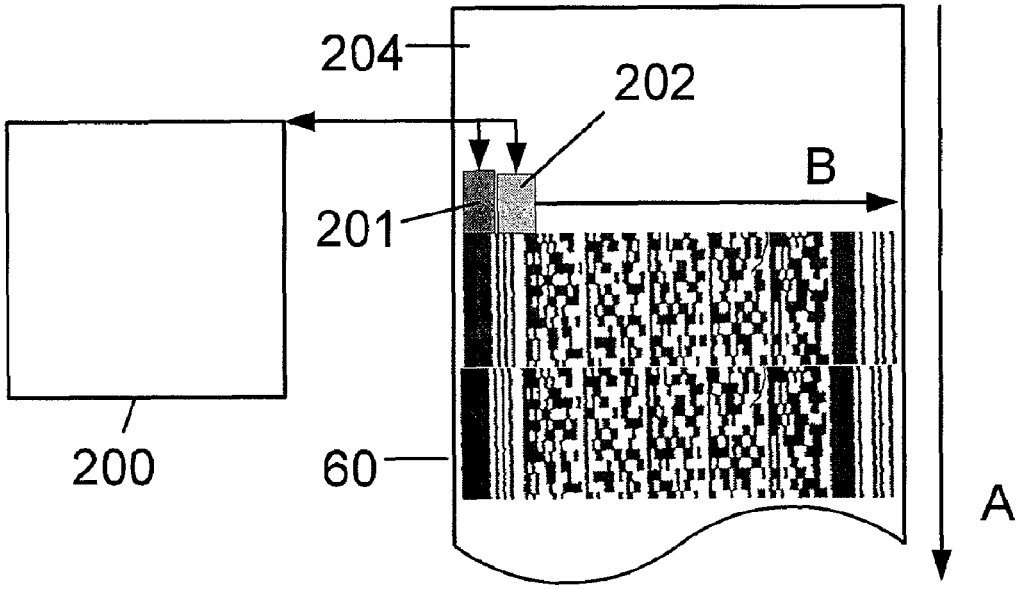
FIG. 10 is a drawing of the apparatus of this invention showing two print heads (ink and facilitator) that print the enhanced barcode 60.

FIG. 10 is a drawing of the apparatus of this invention showing two print heads (ink 201 and facilitator 202) that print the enhanced barcode 60. Print head controller 200 is coupled to print head 201 that ejects a black ink and controller 200 is coupled to print head 202 that ejects the facilitator for the aforementioned black ink. Controller 200 causes ink drops from print head 201 and facilitator from ink jet 202 to fall on paper 204 that moves in direction A. Ink jets 201 and 202 move in direction B. Controller 200 will cause print heads 201 and 202 to print bar code 60.

It would be obvious to one skilled in the art that controller 200 may be used to control various print heads that eject colored inks so that bar code 60 may be a bar code that has multiple colors. Bidirectional print heads may utilize dual facilitator heads (either side) or ink which remain unfixed long enough for the facilitator to be effective when deposited after the ink is printed.

Figure 11:
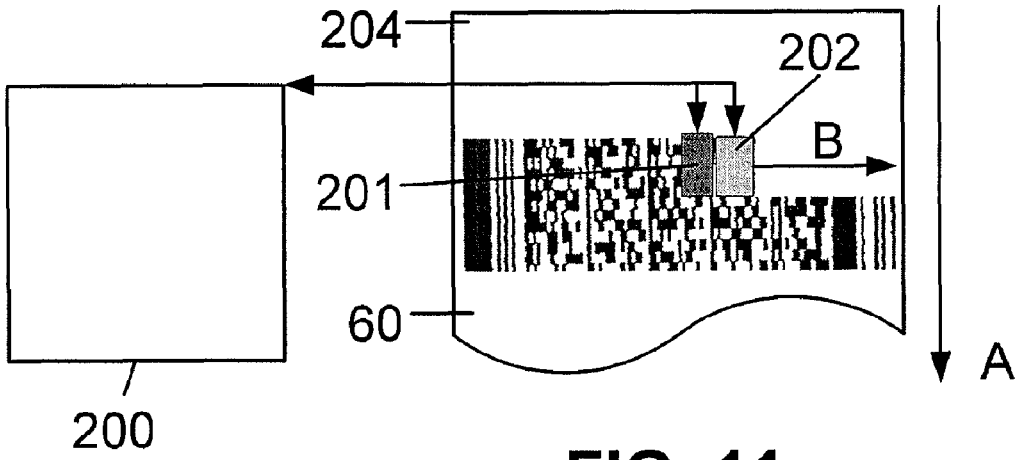
FIG. 11 is a drawing of the apparatus of this invention showing two print heads (ink and facilitator) as they move across the paper 204 leaving a trail of printed enhanced barcode data elements.

FIG. 11 illustrates the black and facilitator print heads (201, 202) as they progress across the paper (204) in direction B printing a strip of the rasterized barcode (60). Printed material is visible to the left of the print heads while the paper remains white in advance of the print operation to the right. When the print strip is complete, the paper will advance the height of a print strip, the print head will reset to the left position, and the print operation can repeat. The present invention recognizes that columns of pixels are printed simultaneously across the face of the print head as it advances across the paper but that pixels in subsequent strips will be printed with a significant latency. For this reason, under circumstances of fast drying and rapidly setting inks, it may be desirable to operate the pixel stripping algorithms only within the confines of each printing swatch rather than across the entire rasterized image. In this manner the facilitator may enhance coverage of the inks before they set.

The extraordinary diversity of ink vendors, ink formulations, printers, and paper types make it impractical to define specific ink formulations for use in the present invention. It is, however, possible to provide specific guidelines for their determination. First, each ink has a material, solvent, or fluid ("facilitator") which facilitates the enhanced coverage of ink into nearby areas. If this facilitator is applied when the ink is printed as described in this application then the ink will be better able to spread into the unwanted voids 67 and enhance coverage.

The application describes the concept of taking the area to be printed and pixel trimming the dimensions of that area for application of the facilitator to prevent unintended bleed of the ink. A straightforward calibration process may be utilized to determine the desired facilitator load and pixel trimming of the print area for facilitator application. A monochrome black dot pattern, as presented in the application figures, may be printed and the unintended voids between pixels observed as well as the quality of test barcodes. Test patterns (A-Z) allow for a progressive series of dot or barcode tests in which the quantity of facilitator and number of pixels trimmed is varied:

TABLE 1

Matrix Describing Print Quality Test Barcodes

| Pixels Trimmed | 0% | % 25% | Maximum 50% | Facilitator 75% | 100% |
|---|---|---|---|---|---|
| 0 | A | B | C | D | E |
| 1 | F | G | H | I | J |
| 2 | K | L | M | N | O |
| 5 | P | Q | S | T | U |
| 10 | V | W | X | Y | Z |

The control test cases "A, F, K, P, and V" correspond to the instances in which no facilitator is applied (and therefore the trimming of the pixels is moot). At the opposite extreme, test cases in the final column represent instances in which the maximum facilitator is applied. Comparison of case "E" (no pixels trimmed) to cases with progressively greater numbers of pixels trimmed ("J, O, U, Z") will reveal the point at which the enhanced coverage extends beyond the boundaries is the intended pattern and therefore is causing unwanted image distortion. This test pattern would easily fit on a single sheet of paper and therefore the test print is accomplished quickly. Selection of the "best" pattern in which black and white pixels are of equal size could be done by visual inspection (as alignment patterns are done on many printers today) or through automation. Test cases may also be included to identify the effects of paper grain and allow setting of different pixel trimming parameters in the horizontal and vertical axes. An automated solution would be to utilize a barcode reader/verifier to read each of the printed barcodes and identify the point at which the read rates and quality are highest.

Since print media differ considerably in porosity (capacity for unintended ink bleed), different settings would be expected to be required for blotting paper and plastic transparency film. Vendors might choose to pretest and calibrate their inks (they know what inks they sell with particular printer models) and incorporate the settings into the control systems or printer drivers for their printers. Printers that sense the paper media could then utilize the media types with the corresponding facilitator strength and pixel trimming parameters. Since paper grain is typically aligned with the long axis of the paper, printers could adapt pixel trimming algorithms accordingly based upon the landscape (horizontal) or portrait (vertical) orientation of the paper.

Some print heads may have the ability to delivery varying quantities of ink (underdrive or overdrive) resulting in reduced or enlarged pixels as described in other applications by Check and Sansone in U.S. Pat. No. 4,386,272 assigned to Pitney Bowes Inc. In such instances, the quantities of black ink delivered within regions 68 or 71 may be deliberately increased to produce enlarged pixels and the volumes of ink delivered to pixels within regions 72 may be reduced to produce reduced pixels. Dithering of pixels (deliberate omissions of pixels within a large region to reduce the overall intensity of the print while maintaining image integrity) may also be used to reduce unwanted pooling of ink due to saturation in large print areas 71.

The above specification describes a new and improved method for improving the readability of printed matter. It has been described with reference to black ink on white paper. It is realized that the above description may indicate to those skilled in the art additional ways in which the principles of this invention may be used without departing from the spirit including the use of any ink colors with the corresponding facilitators to allow them to enhance coverage and provide a better quality of print and the use of bidirectional printers. It is, therefore, intended that this invention be limited only by the scope of the appended claims.

What is claimed is:

1. A method comprising the steps of:

printing a plurality of data elements on a medium to form a barcode, each of the plurality of data elements including a plurality of printed pixels;

determining a subset of the plurality of printed pixels for at least one of the plurality of data elements, the subset of the plurality of printed pixels defining an enhanced coverage area within the at least one of the plurality of data elements; and applying a substance to the enhanced coverage area, the substance facilitating the spread of the subset of the plurality of printed pixels of the enhanced coverage area on the medium thereby enhancing the readability of the at least one data element and the barcode.

2. A method as recited in claim 1, further comprising defining a portion of the enhanced coverage area wherein for those printed pixels within the portion a reduced amount of the substance is applied as compared to an amount of the substance applied to rest of the subset of the plurality of printed pixels of the enhanced coverage area.

3. A method as recited in claim 1, wherein the enhanced coverage area is a square.

4. A method as recited in claim 1, wherein the enhanced coverage area is a rectangle.

5. A method as recited in claim 4, wherein the medium is paper and width of rectangle is aligned along the grain of the paper.

6. A method as recited in claim 1, wherein the plurality of printed pixels of the barcode are printed by a first inkjet printer and the substance is applied by a second inkjet printer.

7. A method as recited in claim 6, wherein the second inkjet printer applies the substance on a pixel by pixel basis to each of the pixels of the subset of the plurality of pixels.

8. A method as recited in claim 1, wherein the spread of the subset of the plurality of printed pixels darkens the enhanced coverage area as compared to the enhanced coverage area without application of the substance.

* * * * *